US007364792B2

(12) United States Patent
Hütte

(10) Patent No.: US 7,364,792 B2
(45) Date of Patent: Apr. 29, 2008

(54) SPUN-DYED POLYURETHANEUREA FIBRES, A PROCESS FOR THEIR PRODUCTION AND THEIR USE FOR PRODUCING FABRICS

(76) Inventor: Stephan Hütte, In den Blechenhöfen 22a, D-51371 Leverkusen (DE)

( * ) Notice: Subject to any disclaimer, the term of this patent is extended or adjusted under 35 U.S.C. 154(b) by 216 days.

(21) Appl. No.: 11/371,401

(22) Filed: Mar. 9, 2006

(65) Prior Publication Data

US 2006/0210794 A1 Sep. 21, 2006

(30) Foreign Application Priority Data

Mar. 19, 2005 (DE) ..... 10 2005 012 797

(51) Int. Cl.
*D02G 3/00* (2006.01)

(52) U.S. Cl. ..... 428/364; 428/372; 524/173; 524/495; 264/78; 264/171.1; 264/205; 264/103

(58) Field of Classification Search ..... 428/364, 428/372; 524/495, 173; 264/211, 78, 103, 264/171.1, 184, 205
See application file for complete search history.

(56) References Cited

U.S. PATENT DOCUMENTS

| | | | | |
|---|---|---|---|---|
| 5,969,028 | A * | 10/1999 | Hutte | 524/436 |
| 6,127,506 | A * | 10/2000 | Greene | 528/61 |
| 6,663,959 | B1 * | 12/2003 | Zweering et al. | 428/364 |
| 6,915,896 | B2 * | 7/2005 | Jones | 198/672 |
| 2005/0038138 | A1 * | 2/2005 | Hutte et al. | 523/210 |
| 2006/0210794 | A1 * | 9/2006 | Hutte | 428/364 |

* cited by examiner

*Primary Examiner*—N. Edwards
(74) *Attorney, Agent, or Firm*—Norris McLaughlin & Marcus

(57) ABSTRACT

Described are elastic polyurethaneurea fibres comprising a cationically modified carbon black as an additive, so that the colour of the fibre is distinctly changed. Also described are a process for producing coloured polyurethaneurea fibres and also their use for producing elastic fabrics and textile goods.

8 Claims, No Drawings

SPUN-DYED POLYURETHANEUREA FIBRES, A PROCESS FOR THEIR PRODUCTION AND THEIR USE FOR PRODUCING FABRICS

FIELD OF THE INVENTION

The invention relates to elastic polyurethaneurea fibres comprising a cationically modified carbon black so that the colour of the fibre is distinctly changed and also to a process for their production and to their use for producing fabrics.

TECHNICAL BACKGROUND OF THE INVENTION

The term "fibre" as used herein comprises staple fibres and continuous filaments which can be produced by principally known spinning processes such as dry spinning, wet spinning or melt spinning.

These spinning processes are described for example in Polyurethanhamstofffasern, H. Gall and M. Kausch in Kunststoff-Handbuch 7, Polyurethane, editor: G. Oertel, Carl Hanser Verlag Munich Vienna, 1993, pages 679 to 694.

Elastic polyurethaneurea fibres composed of long-chain synthetic polymers that are constructed to an extent of at least 85% of segmented polyurethanes based for example on polyethers, polyesters and/or polycarbonates are well known. Yarns composed of such fibres are used for producing fabrics which in turn are useful inter alia for foundation garments, stockings and sportswear, examples being bathing costumes and swimming trunks.

Polyurethaneurea fibres possess outstanding elasticity and substantial extensibility combined with high resiling forces. Owing to this outstanding combination of properties, they are widely used in the apparel sector. When used to produce dark textiles in the apparel sector which are elasticized through polyurethaneurea fibres, it is difficult to obtain a uniform coloration or visual appearance of the various yarns. The reason is that the various yarns used for producing the textile have different hues. If, for example, the inelastic yarn has a dark hue, a conventionally used elastic polyurethaneurea fibre will become visible in the textile and "grin through" and thus disrupt the visual appearance of the textile. Another method of producing dark textiles in the apparel sector which are elasticized through polyurethaneurea fibres is dyeing with the desired dye. However, dyeing is a technically inconvenient, additional and hence also cost-raising process step in the manufacturing chain of the textile.

The literature describes a method of producing a dark polyurethaneurea fibre.

As described in the KR-A-2002092588 application, a black polyurethaneurea fibre is obtainable by incorporating graphite as an additive. True, the polyurethaneurea fibres thus obtained are coloured and have a black colour, but the incorporation of carbon black in polyurethaneurea fibres very quickly gives rise to agglomerates which disrupt the spinning operation by clogging filters. Furthermore, the agglomeration of the carbon black may disrupt its disbursement in the fibre to such an extent that the fibre is no longer consistent in thickness. This can lead to a dishomogeneous colour for the fibre and also to broken ends in the further processing into textiles.

As described in DE-A-10 2004 003 997, a dark polyurethaneurea fibre may be obtained by incorporating dark spinel pigment based on iron oxide as an additive. True, the polyurethaneurea fibres thus obtained are coloured and have a dark colour, but their processing properties to produce the fibres are not good enough. For instance, metering pumps metering the solutions comprising the hard spinel pigments may become damaged by abrasion. Thus, the incorporation of dark spinel pigment based on iron oxide as an additive in a polyurethaneurea composition cannot be done constantly over a long period. Owing to metering fluctuations, levels of spinel pigment in the polyurethaneurea fibre will vary and generally become ever lower. This can result in ever lighter polyurethaneurea fibres which on further processing of the fibres into textiles then can lead to undesirable differences in colour.

The present invention, then, has for its object to provide dark polyurethaneurea fibres which do not have the aforementioned disadvantages of the polyurethaneurea fibres described above. The spinning operation to produce the polyurethaneurea fibre shall not be disrupted through the formation of agglomerates in the spinning solution for example. Nor shall any change in hue occur during the production of the polyurethaneurea fibre, nor during the processing of the polyurethaneurea fibre in the textile processing chain and in the use of the finished articles.

DETAILED DESCRIPTION OF THE INVENTION

We have found that the dark coloration of polyurethaneurea fibres is achieved when a cationically modified carbon black is added to the polyurethaneurea spinning solution before spinning. We have found that the mechanical performance data of the polyurethaneurea fibres are not adversely affected by this addition, that there is no formation of agglomerates to disrupt the spinning operation to produce the polyurethaneurea fibre and that there is no change in hue during the spinning operation or in the course of the further processing in the textile processing chain and in the use of the finished articles. We have further found that the incorporation of the additive in the polyurethaneurea spinning solution is possible without major cost and inconvenience, since the dispersibility of the cationically modified carbon black used is outstanding and a homogeneous disbursement of the carbon black within the polyurethane fibre is obtained.

The invention provides polyurethaneurea fibres comprising

A) 99.9% to 70% by weight, especially 99.8% to 80% by weight and especially preferably 99.7% to 85% by weight of polyurethaneurea polymer, B) 0.05% to 8% by weight, especially 0.1% to 5% by weight and especially preferably 0.2% to 3% by weight of cationically modified carbon black, the cationically modified carbon black being uniformly disbursed in the fibre, and if appropriate C) 0% to 20% by weight and especially 0% to 15% by weight of additives.

The dark hue of the elastane threads consisting of polyurethaneurea provides a good visual appearance to textiles produced in dark hues.

The polyurethaneurea fibres of the present invention are based on segmented polyurethaneurea polymers. The polymers have a segmented structure, i.e. they consist of "crystalline" and "amorphous" blocks (so-called hard segments and soft segments respectively).

Polyurethaneurea fibres can be produced in particular from a linear homo or copolymer having a hydroxyl group at each end of the molecule and a molecular weight in the range from 600 to 4000 g/mol, such as polyetherdiols, polyesterdiols, polyesteramidediols, polycarbonatediols or from a mixture or from copolymers of this group. Particular preference is given to polyesterdiols and polyetherdiols and most preference is given to polyesterdiols, since polyesterdiols are stable to degradation by chlorinated water without addition of further stabilizers. They are further based on organic diisocyanates with which the polymeric diols are reacted to form terminally isocyanate-functional prepolymers, and diamines or mixtures of various diamines as chain extenders with which the terminally isocyanate-functional prepolymers are reacted to form high polymers.

Examples of organic diisocyanates are 4,4'-dicyclohexylmethane diisocyanate, isophorone diisocyanate and 4,4'-diphenylmethane diisocyanate. Examples of diamines are ethylenediamine, 1,2-propanediamine, 2-methyl-1,5-diaminopentane, isophoronediamine, 1,3-diaminocyclohexane, 1-methyl-2,4-diaminocyclohexane or 1,2-diaminocyclohexane.

Polyurethaneurea fibres can be produced by principally known processes, as for example by processes described in U.S. Pat. Nos. 3,553,290 and 3,555,115 and in WO 93/09 174.

The cationic modification of carbon black is effected by adding a nitrogenous base to the carbon black before or during the incorporation into the polyurethaneurea composition and the subsequent spinning operation for producing the polyurethaneurea fibre. The amount of nitrogenous base added to the carbon black is in the range from 0.05% to 30%, especially in the range from 0.1% to 20% and especially preferably in the range from 0.2% to 15% based on weight percent of carbon black.

Useful carbon blacks include those which are produced by conventional processes such as the furnace black process, the gas black process or the lamp black process, more preferably by the furnace black process or the gas black process and most preferably by the gas black process. The furnace black process is a continuous process utilizing liquid and gaseous hydrocarbons. The reaction takes place at high temperatures in a ceramic-lined furnace. After carbon black formation, the process gas mixture is abruptly cooled down by injection of water. In the gas black process, a hydrogenous gas is passed over a heated oil and the carrier gas saturated with oil vapours is fed to a burner tube which carries a multiplicity of small burner hats. The many small flames impinge upon a water-cooled roll at which the carbon black formed then becomes deposited. In the lamp black process, the liquid or molten raw materials are received in a cast-iron dish lined with a refractorily brick-walled take-off hood and are incinerated. The carbon black then separates off onto condensers.

Useful nitrogenous bases for cationic modification of carbon black include aliphatic amines, especially methylamine, ethylamine, propylamine, isopropylamine, butylamine, sec-butylamine, tert-butylamine, 3-methyl-1-butaneamine, hexylamine, octylamine, 2-ethylhexylamine, dimethylamine, diethylamine, dipropylamine, dibutylamine, dihexylamine, di(2-ethylhexyl)amine, trimethylamine, triethylamine, tripropylamine, tributylamine, trihexylamine, tris(2-ethylhexyl)amine, N,N-dimethylethylamine, dimethylpropylamine, N,N-dimethylisopropylamine and N,N-dimethylbutylamine, alkoxyalkylamines, especially 2-methoxyethylamine, 3-methoxypropylamine and di(2-methoxyethyl) amine, cycloaliphatic, aliphatic-aromatic and aromatic amines, especially cyclopentylamine, cyclohexylamine, N-methylcyclohexylamine, N-ethylcyclohexylamine, dicyclohexylamine, N,N-dimethylcyclohexylamine, benzylamine and ethylaniline, polyamines, especially ethylenediamine, 1,3-propanediamine, 1,2-propanediamine, neopentanediamine, hexamethylenediamine, octamethylenediamene, isophoronediamine, 3-(methylamino)propylamine, 3-(cyclohexylamino)propylamine, 2-(diethylamino) ethylamine, 3-(dimethylamino)propylamine, 3-(diethylamino)propylamine, 1-diethylamino-4-aminopentane, N,N,N',N'-tetramethyl-1,3-propanediamine and N,N,N',N'-tetramethyl-1,6-hexanediamine and aminohydroxy compounds, especially monoethanolamine, 3-amino-1-propanol, isopropanolamine, 5-amino-1-pentanol, aminoethylethanolamine, N-methylethanolamine, N-ethylethanolamine, N-butylethanolamine, diethanolamine, 3-(2-hydroxyethylamino)-1-propanol, diisopropanolamine, N,N-dimethylethanolamine, N,N-diethylethanolamine, N,N-dimethylisopropanolamine, N,N-dibutylethanolamine, 3-dimethylamino-1-propanol, N-methyldiethanolamine, N-butyldiethanolamine, triethanol amine and triisopropanolamine.

Particularly preferred nitrogenous bases are aliphatic amines, in particular those from the group consisting of propylamine, butylamine, sec-butylamine, tert-butylamine, 3-methyl-1-butaneamine, hexylamine, 2-ethylhexylamine, diethylamine, dipropylamine, dibutylamine, dihexylamine and di(2-ethylhexyl)amine, alkoxyalkylamines, in particular from the group consisting of 2-methoxyethylamine, 3-methoxypropylamine and di(2-methoxyethyl)amine, cycloaliphatic amines, in particular those from the group consisting of cyclohexylamine, polyamines, especially ethylenediamine, 1,3-propanediamine, 1,2-propanediamine, neopentanediamine, 3-(methylamino)propylamine, 2-(diethylamino)ethylamine, 3-(diethylamino)propylamine and 1-diethylamino-4-aminopentane, and aminohydroxy compounds, in particular those from the group consisting of monoethanolamine, 3-amino-1-propanol, isopropanolamine, 5-amino-1-pentanol, aminoethylethanolamine, N-methylethanolamine, N-ethylethanolamine, N-butylethanolamine, diethanolamine, diisopropanolamine, N,N-dimethylethanolamine, N,N-diethylethanolamine, N,N-dimethylisopropanolamine, N,N-dibutylethanolamine, N-methyldiethanolamine and N-butyl-diethanolamine.

Very particularly preferred nitrogenous bases are aliphatic amines, especially 3-methyl-1-butaneamine, hexylamine, 2-ethylhexylamine, diethylamine, dibutylamine, dihexylamine and di(2-ethylhexyl)amine, polyamines, especially ethylenediamine and 1,2-propanediamine, and aminohydroxy compounds, especially monoethanolamine, 3-amino-1-propanol, aminoethylethanolamine, N-ethylethanolamine, diethanolamine, N,N-dimethylethanolamine, N,N-diethylethanolamine, N-methyldiethanolamine and N-butyldiethanolamine.

The invention further provides polyurethaneurea fibres comprising

A) 99.9% to 70% by weight, especially 99.8% to 80% by weight and especially preferably 99.7% to 85% by weight of polyurethaneurea polymer, B) 0.05% to 8% by weight, especially 0.1% to 5% by weight and especially preferably 0.2% to 3% by weight of cationically modified carbon black, the cationically modified carbon black being uniformly disbursed in the fibre and the carbon black having a BET surface area in the range from 20 to 550 $m^2/g$, especially in the range from 50 to 350 $m^2/g$, especially preferably in the range from 70 to 300 $m^2/g$ and very especially preferably in the range from 90 to 250 $m^2/g$, and if appropriate C) 0% to 20% by weight and especially 0% to 15% by weight of additives.

BET surface area determination is a well-known method named after Brunauer, Emmett and Teller and encompasses the external and internal surface areas of the carbon black. It thus provides a measure for the total surface area of the carbon black and also encompasses pores and fissures in the carbon black.

The invention further provides for a method of the use of cationically modified carbon black for producing dark polyurethaneurea fibres wherein the cationically modified carbon black is uniformly dispersed in the fibre at 0.05% to 8% by weight, especially at 0.1% to 5% by weight and especially preferably at 0.2% to 3% by weight.

The cationically modified carbon black can be added to the polyurethaneurea spinning solution in the course of the production of polyurethaneurea fibres at any desired point in the processing of the composition. For example, the cationically modified carbon black may be added as a powder or in the form of a dispersion to a solution, dispersion or slurry of other additives. The cationically modified carbon black when it is used in the processing to form fibres can then be mixed with or injected into the polymer spinning solution upstream of the fibre-spinning dies. It will be appreciated that the cationically modified carbon black can also be added separately to the polymer spinning solution as a powder or in the form of a dispersion in a suitable medium. The cationically modified carbon black can further be added in the abovementioned combinations in the course of the ordinary production of polyurethaneurea.

The polyurethaneurea fibres of the present invention may if appropriate comprise additives C) for various purposes including delusterants, fillers, antioxidants, dyes, release agents, antistats, stabilizers against heat, light, UV radiation, nitrogen oxides, chlorinated water and against fumes.

Examples of antioxidants, stabilizers against heat, light, UV radiation or nitrogen oxides are stabilizers from the group of the sterically hindered phenols, hindered amine light stabilizers (HALSs), triazines, benzophenones and benzotriazoles. Examples of release agents are magnesium stearate, calcium stearate and aluminium stearate. Examples of antistats are alkali metal salts of sulphosuccinic esters or ethylene-oxide- or propylene-oxide-modified silicones. Examples of pigments and delusterants are titanium dioxide, zinc oxide and barium sulphate. Examples of dyes are acid dyes, disperse dyes and pigment dyes and optical brighteners. Examples of stabilizers against degradation of the fibres by chlorine or chlorinated water are zinc oxide, magnesium oxide, magnesium calcium hydroxycarbonates or magnesium aluminium hydroxycarbonates. The stabilizers mentioned can also be used in mixtures. The additives mentioned should preferably be added in such amounts that they do not exhibit any effects contrary to the cationically modified carbon black.

Carbon blacks, as mentioned at the beginning, may exist in the form of agglomerates in polar solvents such as for example dimethylacetamide, dimethylformamide or dimethyl sulphoxide which are customarily used in the dry- or wet-spinning operation to produce fibres from polyurethaneurea. For this reason, there is a danger than spinning solutions comprising incorporated carbon black may during the spinning operation give rise to difficulties due to clogging of the spinneret dies whereby die pressure builds up steeply and/or the disbursement of the carbon black in the fibre is not homogeneous and/or the freshly formed fibres may snap off before or in the course of being wound onto a package. Surprisingly, incorporation of cationically modified carbon black in polyurethaneurea spinning solutions according to the invention does not give rise to any agglomeration in the spinning solution. This ensures a long service life of the spinneret dies without pressure build-up at the spinneret dies, a homogeneous and consistent disbursement of the modified carbon black in the fibre with a consistent hue and hence good process consistency and economics in the dry or wet spinning of the polyurethaneurea fibres of the present invention.

The invention further provides a process for producing spun-dyed polyurethaneurea fibres by dry spinning or wet spinning, preferably by dry spinning, by producing the spinning solution, spinning the spinning solution through a spinneret die, filament formation below the spinneret dye through removal of the spinning solvent by drying or in a coagulation bath, spin finishing and winding up the filaments, characterized in that from 0.05% to 8% by weight, especially from 0.1% to 5% by weight and especially preferably from 0.2% to 3% by weight of cationically modified carbon black is added to the polyurethaneurea spinning solution before spinning of the solution into polyurethaneurea fibre and is uniformly disbursed in the fibre.

The invention further provides for a method of use of the present invention's polyurethaneurea fibres for producing elastic wovens, drawn-loop knits, formed-loop knits and other textile goods. The polyurethaneurea fibres of the present invention are preferably used in the production of blend fabrics together with other dark yarns based on a synthetic, for example a polyamide, a polyester or a polyacrylonitrile, or non-synthetic fibres, for example cotton, wool, linen or silk.

The invention will now be more particularly described by non-limiting examples in which all percentages are based on the total weight of fibre, unless otherwise stated.

EXAMPLES

The polyurethaneurea spinning solution employed for the inventive and comparative examples hereinbelow was produced by the following procedure:

A polyurethaneurea spinning solution was prepared from a polyesterdiol having an average molecular weight of 2000 g/mol that consists of adipic acid, hexanediol and neopentylglycol, was capped with methylene bis(4-phenyl diisocyanate) (MDI) and then chain extended with a mixture of ethylenediamine (EDA) and diethylamine (DEA). The molecular weight reported for the polyesterdiol is the number average molecular weight.

The polyurethaneurea spinning solution was prepared by mixing 49.88 parts by weight having a molecular weight of 2000 g/mol with 1.00 part by weight of 4-methyl-4-azaheptane-2,6-diol and 36.06 parts by weight of dimethylacetamide (DMAc) and 13.06 parts by weight of MDI at 25° C., heating to 50° C., maintaining at 50° C. for 110 minutes and then cooling down to 25° C. to obtain an isocyanate-capped polymer having an NCO content of 2.65% of NCO.

Chain extension was effected by rapid mixing of 100 parts by weight of the isocyanate-capped polymer into a solution consisting of 1.32 parts by weight of EDA and 0.03 part by weight of DEA in 189.05 parts by weight of DMAc. The solids content of the resulting polyurethaneurea spinning solution was 22%.

Hexamethylene diisocyanate (HDI) was added to adjust the molecular weight of the polyurethaneurea spinning solution such that it had a viscosity of 70 Pa*s at a measuring temperature of 25° C.

The polyurethaneurea spinning solution was then admixed with a stock batch of additives. This stock batch consisted of 66.6% by weight of dimethylacetamide (DMAc), 11.1% by weight of Cyanox® 1790 (1,3,5-tris(4-tert-butyl-3-hydroxy-2,5-dimethylbenzyl)-1,3,5-triazine-2,4,6-(1H,3H,5H)-trione, from Cytec), 5.7% by weight of Tinuvin® 622 (polymer consisting of succinic acid and 4-hydroxy-2,2,6,6-tetramethyl-1-piperidineethanol, from Ciba), 16.6% by weight of 22% polyurethaneurea spinning solution and 0.001% by weight of Makrolex® Violet dye (from Bayer AG). This stock batch is added to the polyurethaneurea spinning solution such that the level of Cyanox® 1790 was 1.0% by weight based on the entire solids content.

This polyurethaneurea spinning solution was then admixed with a second stock batch. This stock batch consists of 5.5% by weight of Silwet® L 7607 (polyalkoxy-modified polydimethylsiloxane; viscosity: 50 mPas (at 25° C.), molecular weight 1000 g/mol, from OSI Specialties), 5.5% by weight of magnesium stearate, 45.0% by weight of DMAC and 44.0% by weight of a 30% spinning solution and was added such that a magnesium stearate content of 0.30% by weight resulted, based on the solid of the polyurethaneurea polymers.

This polyurethaneurea spinning solution was fed to the spinneret dies. Upstream of the spinneret dies, this polyurethaneurea spinning solution was admixed with a further stock batch comprising the hereinbelow reported amounts of the additive for colouring the polyurethaneurea spinning solution:

Example 1 (Inventive)

1.0% by weight (based on the solids content of the polyurethaneurea spinning solution) of carbon black, as a 10% dispersion in dimethylacetamide (% by weight) with addition of 2.0% by weight of ethylenediamine (based on carbon black) and 50% by weight of a 22% polyurethaneurea spinning solution (Printe® F80 carbon black from Degussa).

Example 2 (Inventive)

1.0% by weight (based on the solids content of the polyurethaneurea spinning solution) of carbon black, as a 10% dispersion in dimethylacetamide (% by weight) with addition of 10.0% by weight of ethylenediamine (based on carbon black) and 50% by weight of a 22% polyurethaneurea spinning solution (Printex® F80 carbon black from Degussa).

Example 3 (Inventive)

1.0% by weight (based on the solids content of the polyurethaneurea spinning solution) of carbon black, as a 10% dispersion in dimethylacetamide (% by weight) with addition of 2.0% by weight of ethylenediamine (based on carbon black) and 50% by weight of a 22% polyurethaneurea spinning solution (Printex® U carbon black from Degussa).

Example 4 (Inventive)

1.0% by weight (based on the solids content of the polyurethaneurea spinning solution) of carbon black, as a 10% dispersion in dimethylacetamide (% by weight) with addition of 10.0% by weight of dibutylamine (based on carbon black) and 50% by weight of a 22% polyurethaneurea spinning solution (Printex® F80 carbon black from Degussa).

Comparative Example 1 (V1)

1.0% by weight (based on the solids content of the polyurethaneurea spinning solution) of carbon black, as a 10% dispersion in dimethylacetamide (% by weight) and 50% by weight of a 22% polyurethaneurea spinning solution (Printex® F80 carbon black from Degussa).

Comparative Example 2 (V 2)

1.0% by weight (based on the solids content of the polyurethaneurea spinning solution) of Heucodur® Schwarz 9-100 (copper chromite spinel pigment $Cu(Fe,Cr)_2O_4$, Pigment Black 28, from Heubach GmbH) as a 10% dispersion in dimethylacetamide (% by weight) and 50% by weight of a 22% polyurethaneurea spinning solution.

Comparative Example 3 (V 3)

0.2% by weight (based on the solids content of the polyurethaneurea spinning solution) of Makrolex® Black 1 (mixture of 57.0% by weight of Makrolex® Red EG Gran and 43.0% by weight of Makrolex® Green 5B Gran, from Bayer AG) and 50% by weight of a 22% polyurethaneurea spinning solution.

Comparative Example 4 (V 4)

0.2% by weight (based on the solids content of the polyurethaneurea spinning solution) of Makrolex® Black 2 (mixture of 15.0% by weight of Makrolex® Yellow G Gran, 65.5% by weight of Makrolex® Violet 3R Gran and 19.5% by weight of Makrolex® Green 5B Gran, from Bayer AG) and 50% by weight of a 22% spinning solution.

The ready-produced spinning solution was dry spun through spinneret dies in a typical dry-spinning apparatus to produce filaments having a linear density of 11 dtex, four individual filaments at a time being converged together to form coalescent filament yarns. The spin finish (Baysilone® M20 oil from GE Bayer Silicones) was applied via an applicator roll at 4.0% by weight add-on on weight of the polyurethaneurea fibre. The take-off speed of the winder was 550 m/min.

Table 1 shows the observations made during the five-day spinning operation.

TABLE 1

Tabular comparison of observations during spinning operation:

| Example number | Spinning operation assessment |
|---|---|
| 1 | No abnormalities |
| 2 | No abnormalities |
| 3 | No abnormalities |
| 4 | No abnormalities |
| V 1 | Agglomerates in spinning solution; severe build-up of die pressure; spinning operation discontinued after 1 day; inhomogeneous disbursement of carbon black in filament and light hues |
| V 2 | Hue changes (lightens) during spin |
| V 3 | No abnormalities |
| V 4 | No abnormalities |

As the inventive examples show, the spinning operation is not disrupted by the inventive addition of cationically modified carbon black. This likewise relates to the Makrolex® Black 1 and Makrolex® Black 2 additives.

When carbon black which has not been cationically modified is added (Comparative Example V 1), agglomerates form in the spinning solution. During the spinning operation, there is a severe build-up of pressure upstream of the spinneret die, resulting in the continuous spinning operation having to be discontinued. Nor is the disbursement of the carbon black homogeneous in the fibre, and a light hue is obtained. For these reasons, carbon black which has not been cationically modified is not suitable for producing dark polyurethaneurea fibres.

When dark spinel pigment based on iron oxide is added (Comparative Example V 2), the hue cannot be kept consistent during the spinning operation. The dark polyurethaneurea fibre loses depth of shade throughout the spin time. Because of this inconsistent and decreasing addition of the pigment-containing stock batch to the polyurethaneurea solution may be the severe abrasion caused by the dark spinel pigment based on iron oxide. At the end of the spinning run only 0.6% by weight of dark spinel pigment based on iron oxide was found in the polyurethaneurea fibre instead of 1.0% by weight. This is why dark spinel pigments based on iron oxide are not suitable for producing dark polyurethaneurea fibres.

A further test was carried out to examine the extractability of the additives used to effect the dark coloration of the elastane fibre. Tubes consisting of 100% polyurethaneurea fibre were knitted up. The respective knit tubes were subjected to a wash with perc (tetrachloroethylene) as may also occur in the processing chain to produce textiles and in the use of the finished articles. The results are summarized in Table 2.

TABLE 2

Tabulated comparison of changes due to perc wash:

| Example | Perc cleaning |
|---|---|
| 1 | No abnormalities |
| 2 | No abnormalities |
| 3 | No abnormalities |
| V 3 | Severe change in colour; lightening |
| V 4 | Severe change in colour; lightening |

The results show that undesirably severe changes in hue occur due to the perc cleaning of the polyurethaneurea fibres coloured dark with Makrolex® Blacks 1 and 2 in Comparative Examples V 3 and V 4.

Perc cleaning does not cause changes in colour of the polyurethaneurea fibres of the present invention which have been additized with cationically modified carbon black.

Wrapped yarns produced using the polyurethaneurea fibres of the present invention have no visible colour differences after the abovementioned methods of treatment compared with the other, natural- or synthetic-fibre-based yarn used to produce the wrapped yarn.

What is claimed is:

1. Polyurethaneurea fibres consisting essentially of

A) 99.9% to 70% by weight, of polyurethaneurea polymer,

B) 0.05% to 8% by weight, of cationically modified carbon black, the cationically modified carbon black being uniformly disbursed in the fibre.

2. Polyurethaneurea fibres according to claim 1 wherein the cationically modified carbon black is uniformly disbursed in the fibre and the carbon black has a BET surface area in the range from 20 to 550 $m^2/g$.

3. Polyurethaneurea fibres according to claim 1 wherein the polyurethaneurea polymer is prepared from a polyesterdiol.

4. Polyurethaneurea fibres according to claim 1, wherein the carbon black was cationically modified through the addition of an aliphatic amine, of an alkoxyalkylamine, of a cycloaliphatic, aliphatic-aromatic or aromatic amine or of an aminohydroxy compound.

5. The process of producing dark polyurethaneurea fibres which comprises uniformly dispersing cationically modified carbon black in the fibre at 0.05% to 8% by weight.

6. Process for producing coloured polyurethaneurea fibres by dry spinning or wet spinning, preferably by dry spinning, by producing the spinning solution, spinning the spinning solution through a spinneret die, filament formation below the spinneret dye through removal of the spinning solvent by drying or in a coagulation bath, spin finishing and winding up the filaments, characterized in that from 0.05% to 8% by weight, of cationically modified carbon black is added to the polyurethaneurea spinning solution before spinning of the solution into polyurethaneurea fibre and is uniformly disbursed in the fibre.

7. The process of producing elastic wovens, drawn loop knits, formed loop knits and other textile goods which comprises the use of the polyurethaneurea fibres according to claim 1.

8. The process of producing blend fabrics which comprises the use of the polyurethanurea fibres according to claim 1 together with other dark yarns based on a synthetic selected from the group consisting of polyamide, polyester and polyacrylonitrile or non-synthetic fibres selected from the group consisting of cotton, wool, linnen and silk.

* * * * *